US007484259B2

(12) United States Patent
Xu

(10) Patent No.: US 7,484,259 B2
(45) Date of Patent: Feb. 3, 2009

(54) LARGE RESISTING DISTORTION AND MODULARIZED COMB-TYPE BRIDGE EXPANSION JOINT

(76) Inventor: Bin Xu, 205 West Huangshan Road, Beilun Zone, Ningbo Lubao Sci & Tech Industry Group Co. Ltd., Ningbo (CN) 315800

( * ) Notice: Subject to any disclaimer, the term of this patent is extended or adjusted under 35 U.S.C. 154(b) by 0 days.

(21) Appl. No.: 11/916,107

(22) PCT Filed: May 22, 2006

(86) PCT No.: PCT/CN2006/001057

§ 371 (c)(1),
(2), (4) Date: Nov. 30, 2007

(87) PCT Pub. No.: WO2006/131051

PCT Pub. Date: Dec. 14, 2006

(65) Prior Publication Data

US 2008/0196183 A1 Aug. 21, 2008

(30) Foreign Application Priority Data

Jun. 5, 2005 (CN) ..... 2005 1 0049966

(51) Int. Cl.
*E01D 19/06* (2006.01)

(52) U.S. Cl. ..... 14/73.1; 52/396.04

(58) Field of Classification Search ..... 14/73.1; 52/396.04

See application file for complete search history.

(56) References Cited

U.S. PATENT DOCUMENTS 6,022,169 A * 2/2000 Kim et al. ..... 404/52
6,460,214 B1 * 10/2002 Chang ..... 14/73.1

* cited by examiner

*Primary Examiner*—Raymond W Addie
(74) *Attorney, Agent, or Firm*—Global IP Services; Tianhua Gu

(57) ABSTRACT

A large resisting distortion and modularized comb-type bridge expansion joint, comprises at least two modules located parallel in the direction of a bridge's width, and each module includes a fixed comb plate (2) and a movable comb plate (1), which are respectively disposed on girders located at the two sides of the bridge expansion joint, said movable comb plate (1) crosses over the bridge expansion joint, both of said fixed comb plate (2) and said movable comb plate (1) have a plurality of comb teeth (22), (11) at their opposite ends, and the comb teeth (11) of said movable comb plate (1) interdigitate with the comb teeth (22) of said fixed comb plate (2), characterized in that the root of said movable comb plate (1) rotatablely joints with a seat (5) fixed on the girders, and the comb teeth (22) of said fixed comb plate (2) rotatablely joints with the root of said fixed comb plate (2), while, the middle of the comb teeth (22) of said fixed comb plate (2) is movably set on an underlay (6) fixed on the girders and can be shifted transversely relative to the underlay (6). In this invention, when the girders have transverse shift under the effect of the wind or other external forces, the movable comb plate and its comb teeth will rotate correspondingly and the comb teeth of the fixed comb plate will also rotate correspondingly, then the broken of the comb teeth will be avoided.

12 Claims, 10 Drawing Sheets

I-I

LARGE RESISTING DISTORTION AND MODULARIZED COMB-TYPE BRIDGE EXPANSION JOINT

FIELD OF THE INVENTION

The present invention relates to bridge expansion joint, in particular, to a large resistive distortion and modularized comb-type bridge expansion joint.

BACKGROUND OF THE INVENTION

Among recent bridge expansion joints, a relatively good technique is the comb-type expansion joint, which comprises a fixed comb plate and a movable comb plate cooperating with each other, and it is especially applied in the large bridge expansion joint whose expansion amount is more than 160 mm. For example, the Chinese patent No. ZL00264872.0 titled "Assemble Type Comb-type Bridge Expansion Joint" disclosed that invented by Bin Xu, the bridge expanding movement is provided by the movable comb plate which crosses on the bridge expansion, no lengthways transition space is existed between the fixed comb plate and the movable comb plate, and the device is connects the bridge surface and road surface as a whole, thereby, the ability of resisting vibration is very good, the vehicle can drive smoothly and comfortably on the bridge without jumping.

However, to the stayed-cable bridges, suspension bridges and arc-girder bridges, the girder will shift vertically or lengthways under the effect of vehicle loads or temperature. Besides, the girder will shift transversely or rotate under the effect of the wind and other forces. Then either the traditional modulus-type or the comb-type bridge expansion joint cannot meet the need for such shift. The modulus-type joint will cause the lengthways girder and transverse girder separating each other and make the supporting seat broken. And to the comb-type bridge expansion joint, since the comb teeth of it touch rigidly with each other, under such transverse shift, the comb teeth is easy to be broken, and then make the whole expansion joint damaged.

SUMMARY OF THE INVENTION

It is an object of the present invention to provide a large resisting distortion and modularized comb-type bridge expansion joint whose girders can still be whole and not be broken when its girders have large transverse shift or rotation under the effect of the wind and other forces.

The another object of the present invention to provide a large resisting distortion and modularized comb-type bridge expansion joint which can not only resist the transverse shift of the girders but also resist the vertical shift of the girders.

For achieving the above stated object, the expansion joint of the present invention comprises at least two modules located in parallel in the direction of a bridge's width; each module includes a fixed comb plate and a movable comb plate, which are respectively disposed on girders located at the two sides of the bridge expansion joint, said movable comb plate crosses over the bridge expansion joint; both of said fixed comb plate and said movable comb plate have a plurality of comb teeth at their opposite ends, and the comb teeth of said movable comb plate interdigitate with the comb teeth of said fixed comb plate; characterized in that the root of said movable comb plate rotatably joints with a seat fixed on the girders; the comb teeth of said fixed comb plate rotatably joints with the root of said fixed comb plate, while, the middle of the comb teeth of said fixed comb plate is movably set on an underlay fixed on the girder, and can be shifted transversely relative to the underlay.

The rotatably joint between the root of said movable comb plate and the seat can comprise: a columnar rotating shaft projecting downwards fixed at the bottom of the root of the movable comb plate; the seat having a corresponding columnar groove; the columnar rotating shaft and the columnar groove jointing together by fixing bolts; at the border part of them, further more, the holes for the fixing bolts on the seat being in kidney-shape, and filled with resilient damp material around the fixing bolts; a resilient supporting seat can be padded at the bottom of said columnar groove to weaken the forces from flexibility distortion and make the wallop and vibration of vehicles dissolved; And said fixing bolts can go through the movable comb plate and the seat, and the tail step of the fixing bolts and/or surface of the nut are/is in spherical shape, while the seat and/or the movable comb plate have/has a corresponding spherical-shaped groove at their corresponding place, that is to make the whole expansion joint can resist a certain of the vertical shift of girders.

The rotatably joint between the root of said movable comb plate and the seat can also comprises: a columnar rotating shaft projecting downwards fixed at the bottom of the root of the movable comb plate; a similar columnar pin projecting downwards adjacent to the columnar rotating shaft; the seat correspondingly having a columnar groove for containing said columnar rotating shaft and a kidney-shaped groove for containing said columnar pin, and resilient damp material being filled in the space around the columnar pin; a central bolt which goes through the columnar rotating shaft of the movable comb plate and the seat and makes them rotatably joint together; resilient supporting seats can be padded on the bottom of said columnar groove and the bottom of said kidney-shaped groove to weaken the forces from flexibility distortion and make the wallop and vibration of vehicles dissolved; And the tail step of the central bolt and/or surface of the nut are/is in spherical shape, while the seat and/or the movable comb plate have/has a corresponding spherical-shaped groove at their corresponding place, that is to make the whole expansion joint can resist a certain of the vertical shift of girders.

The comb teeth can rotatably joint with the root of the fixed comb plate simply by a pilot pin which goes through the comb teeth and the root of the fixed comb plate, and we can also adopt the other prior existing art.

The comb teeth of the fixed comb plate can joint with the underlay by a pilot pin which goes through the comb teeth of the fixed comb plate and the underlay, the hole for the pilot pin on the underlay is in kidney-shape, and there fills with resilient damp material at the space around the pilot pin, thereby the comb teeth can shift transversely relative to said underlay; Of course, we can also adopt the other prior existing art.

In order to prevent the movable comb plate has excessive vertical shift under the larger forces of distortion, and make the movable comb plate separate from the seat, a safe spring or a safe bolt can connect the root of the movable comb plate and the seat. And the safe bolt goes through the seat and the movable comb plate from the bottom of the seat to the top of the movable comb plate, while, the corresponding hole on the movable comb plate is in step shape, in that hole, there set a compressed spring which ring on the part of the safe bolt above the step of the hole, and the compressed spring is restricted by a nut.

In fact, to resist the vertical shift of the girders, we can adopt the structure disclosed in the Chinese patent No. CN200410049491.5 titled "Large Resisting Distortion Comb-type Bridge Expansion Joint" invented by Bin Xu. Concretely, it can be the form as bellow: the root of the movable comb plate is in comb-shape, and the movable comb plate has a rotating shaft fixed on its undersurface, in the comb-shaped space of the root of the movable comb plate; a shaft seat which comprises a pressing seat and a supporting seat fixed together by a bolt; the pressing seat has a half-columnar groove on its undersurface, and the supporting seat also has a half-columnar groove on its top surface, therefore, the rotating shaft is hold by the shaft seat; the supporting seat has a columnar rotating shaft projecting downwards, and the seat has a corresponding columnar groove, the supporting seat and the seat are jointed together by a fixing bolts at the border part of them, the hole for the fixing bolts on the seat is in kidney-shape, resilient damp material is filled in the space around the fixing bolts.

Compared with the prior art, in this invention, when the girders have transverse shift under the effect of the wind or other external forces, the movable comb plate and its comb teeth will rotate correspondingly and the comb teeth of the fixed comb plate will also rotate correspondingly, and under the effect of the resilient damp material, the forces from flexibility distortion can efficaciously be weaken and the wallop and vibration of vehicles can also be dissolved. Therefore, the wearing out and the damage of the expansion joint will both be mitigated, and the broken of the comb teeth can be avoided. At the same time, the design of the spherical-shaped bolt's surface, the resilient supporting seats, the safe spring, the safe bolt and the special design for vertical rotation, all can further be fit for the vertical shift of the girders, therefore, the whole expansion joint can be fit for the multi-direction shift of the girders, avoid be broken rigidly, and further improve the ability of resisting the wearing out and the damage of the expansion joint, and to extend the time of usage of the expansion joint; While the design of modulation makes the building and maintenance easy, and reduces the fee of manufacture and maintenance.

DETAILED DESCRIPTION OF THE INVENTION

Figure 1:
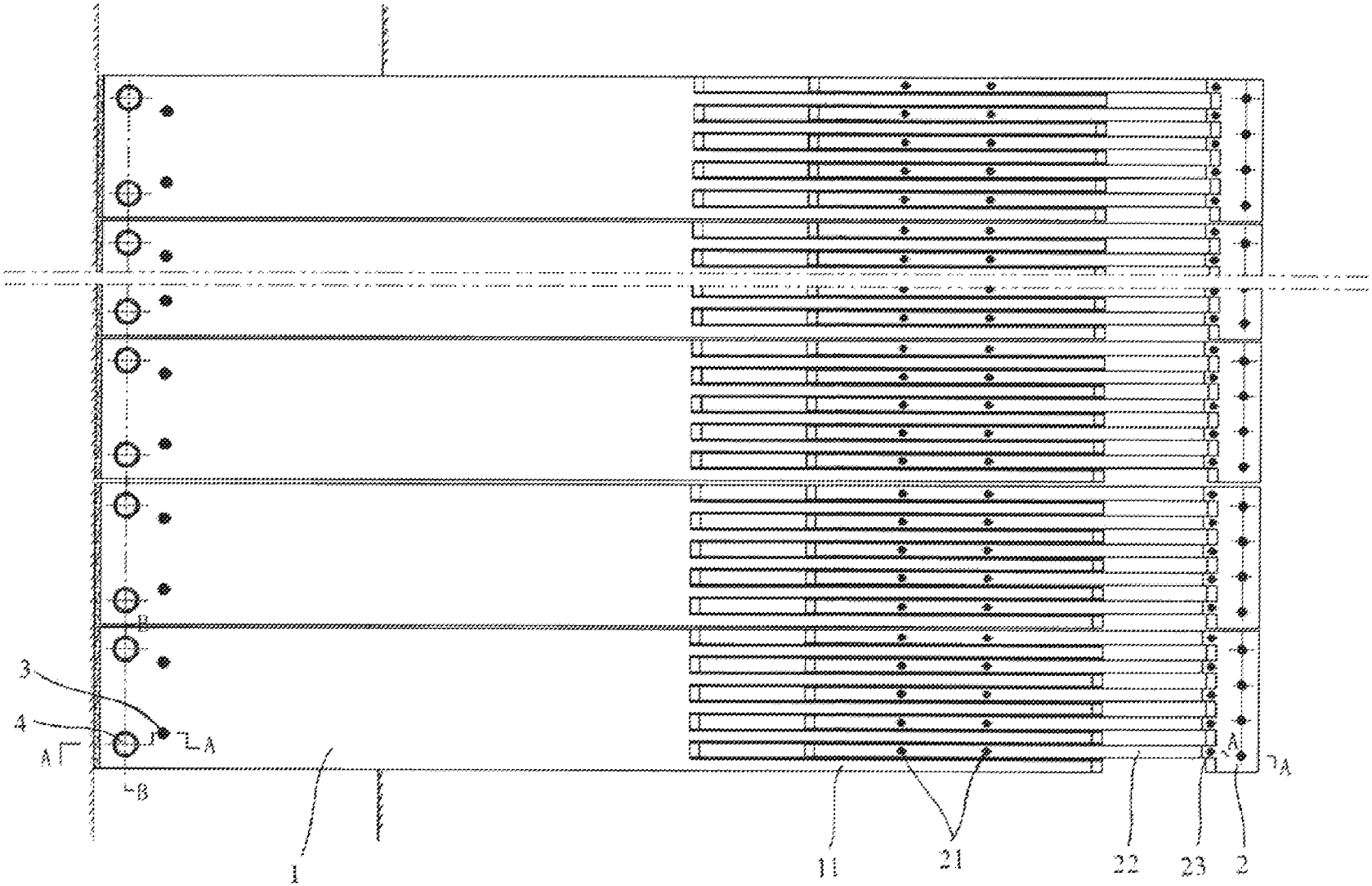
FIG. 1 is a perspective view of the expansion joint of the first embodiment of the present invention.
Figure 2:
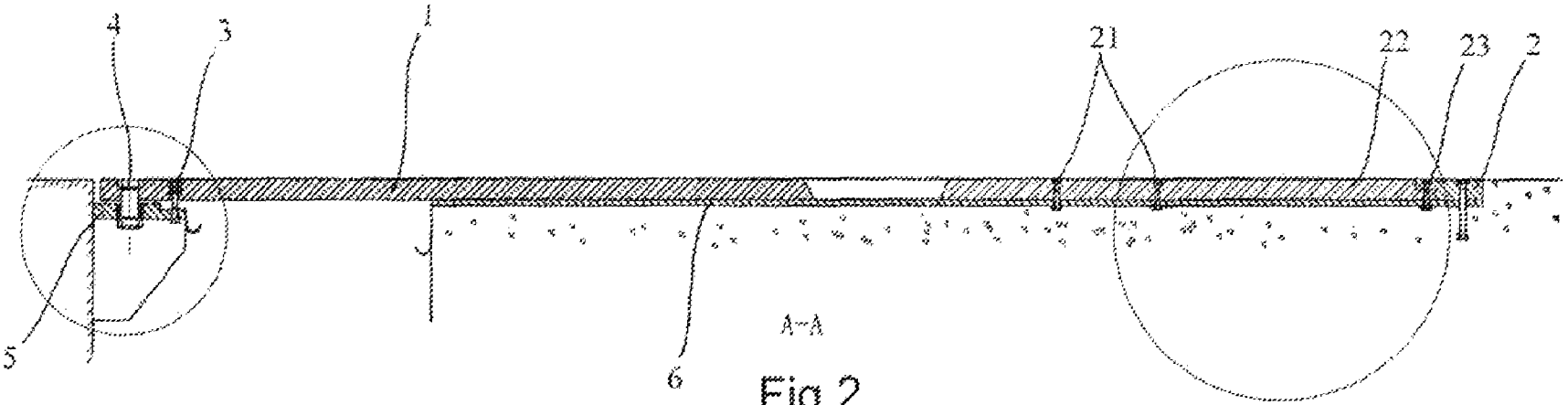
FIG. 2 is the sectional view of A-A way of FIG. 1.

To enable a further understanding of the innovative and technological content of the invention herein, refer to the detailed description of the invention and the accompanying drawings below:

FIGS. 1~9 show the first embodiment of the present invention applied to steel girder. In this embodiment, the large resisting distortion and modularized comb-type bridge expansion joint comprises several modules which locate in parallel in the direction of a bridge's width, and each module includes a fixed comb plate 2 and a movable comb plate 1 which are respectively disposed on girders located at the two sides of the bridge expansion joint, the movable comb plate 1 crosses over the bridge expansion joint, both of the fixed comb plate 2 and the movable comb plate 1 have a plurality of comb teeth 22, 11 at their opposite ends, and the comb teeth 11 of the movable comb plate 1 interdigitate with the comb teeth 22 of the fixed comb plate 2, as shown in FIG. 1 and FIG. 2.

Figure 3:
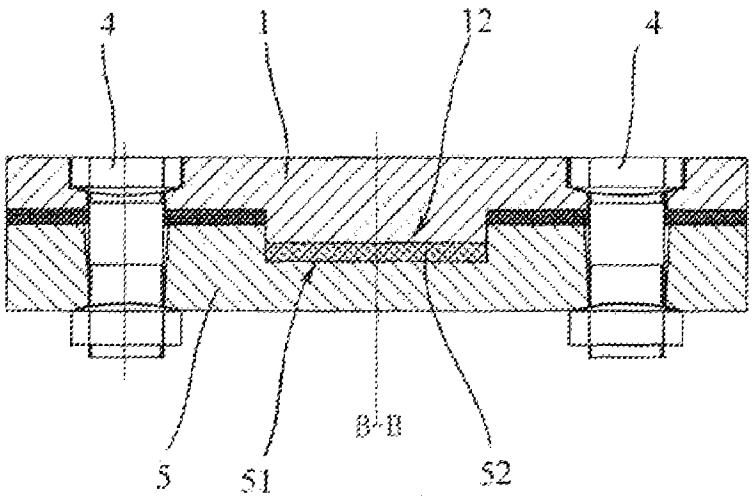
FIG. 3 is the zooming in view of the sectional view of B-B way of FIG. 1.
Figure 4:
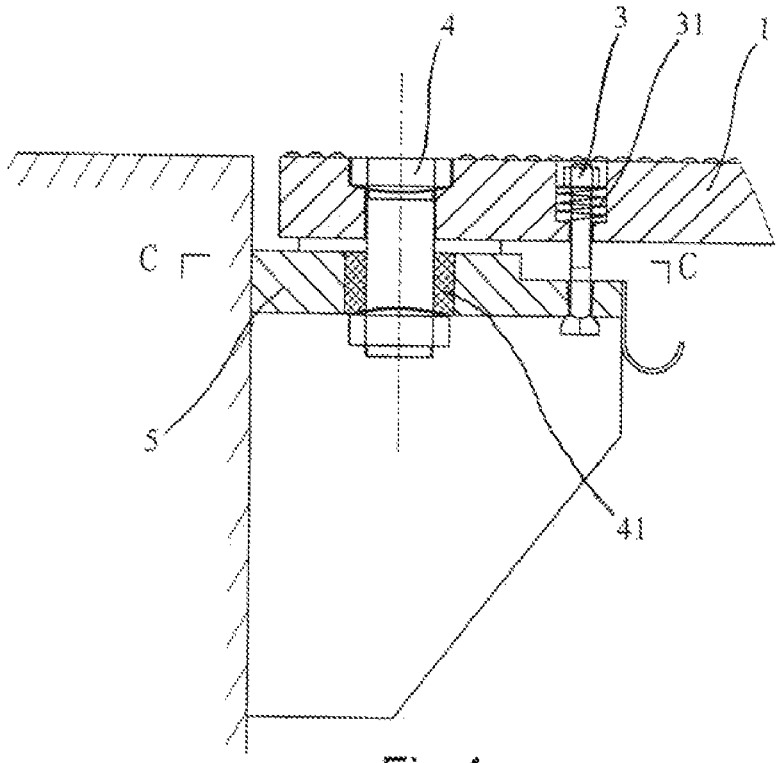
FIG. 4 is the zooming in view of part of FIG. 2.
Figure 5:
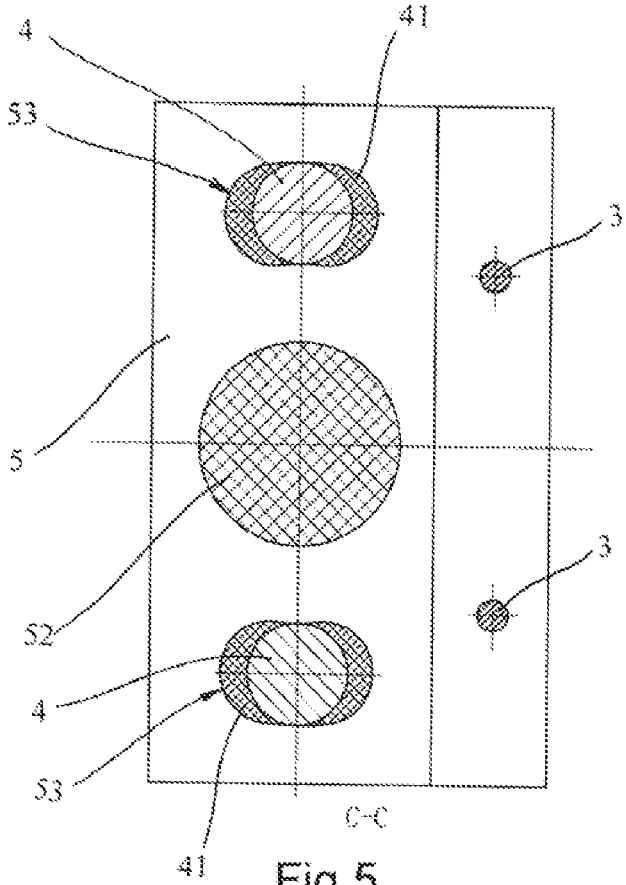
FIG. 5 is the sectional view of C-C way of FIG. 4.

The root of said movable comb plate 1 rotatably joints with a seat 5 fixed on the girder. A columnar rotating shaft 12 projecting downwards is fixed at the bottom of the root of the movable comb plate 1, the seat 5 has a corresponding columnar groove 51 at the bottom of which a resilient supporting seat 52 is padded, while the columnar rotating shaft 12 and the columnar groove 51 joint together by fixing bolts 4 at the border part of them, (the amount of the fixing bolts 4 can accord to actual situation, only one fixing bolts 4 can also work), further more, the hole 51 for the fixing bolts 4 on the seat 5 is in kidney-shape, and resilient damp material 53 is filled in the space around the fixing bolts 4, as shown in FIG. 3, FIG. 4, FIG. 5. A safe bolt 3 connects the root of the movable comb plate 1 and the seat 5, and the safe bolt 3 goes through the seat 5 and the movable comb plate 1 from the bottom of the seat 5 to the top of the movable comb plate 1, while, the corresponding hole on the movable comb plate 1 is in step shape, in that hole, there set a compressed spring 31 which ring on the part of the safe bolt 3 above the step of the hole, and the compressed spring is restricted by a nut, as shown in FIG. 4.

To resist a certain of the vertical shift of girders, the tail step of the fixing bolts 4 and surface of the nut are in spherical shape, while the seat 5 and the movable comb plate 1 have a corresponding spherical-shaped groove at their corresponding place, as shown in FIG. 4.

Figure 6:
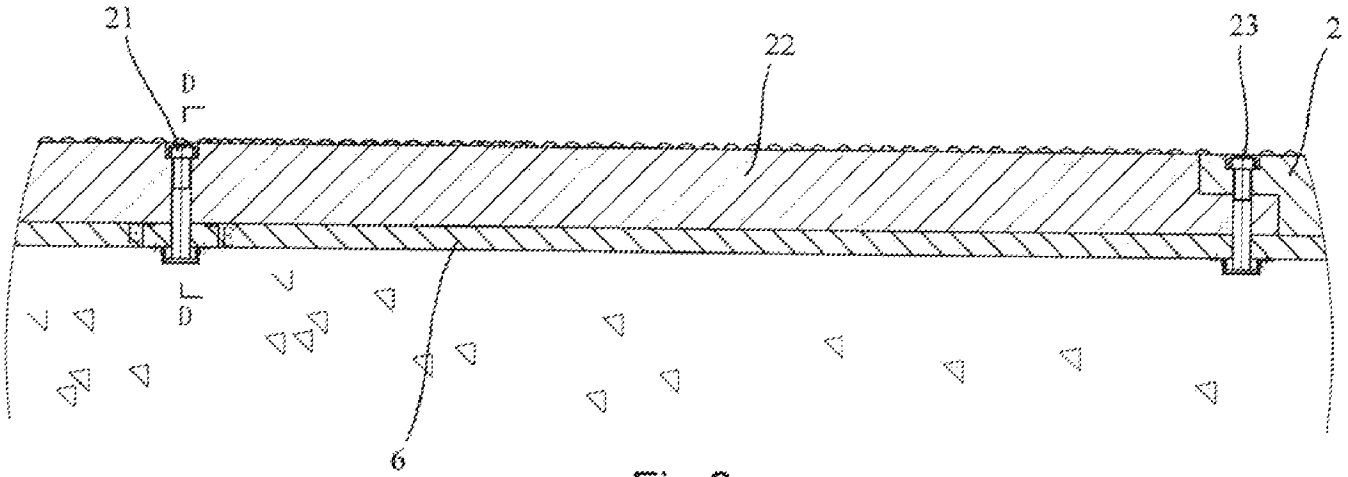
FIG. 6 is the zooming in view of another part of FIG. 2.
Figure 8:
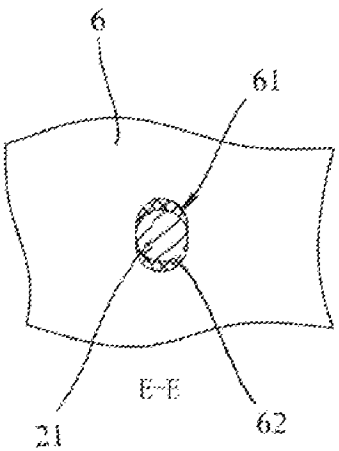
FIG. 8 is the sectional view of E-E way of FIG. 6.
Figure 7:
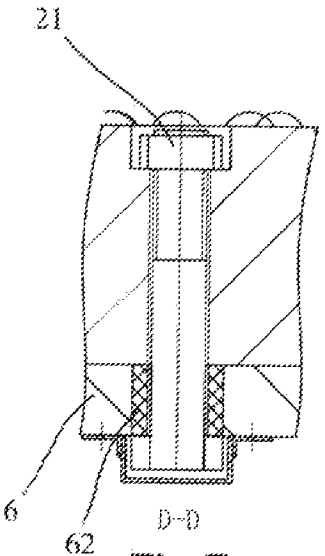
FIG. 7 is the sectional view of D-D way of FIG. 6.

Said fixed comb plate 2 is movably set on an underlay 6 fixed on the girder and the comb teeth 22 rotatably joints with the root of the fixed comb plate 2 by a pilot pin 23 which goes through the comb teeth 22 and the root of the fixed comb plate 2, as shown in FIG. 6, FIG. 7, and FIG. 8.

Figure 9:
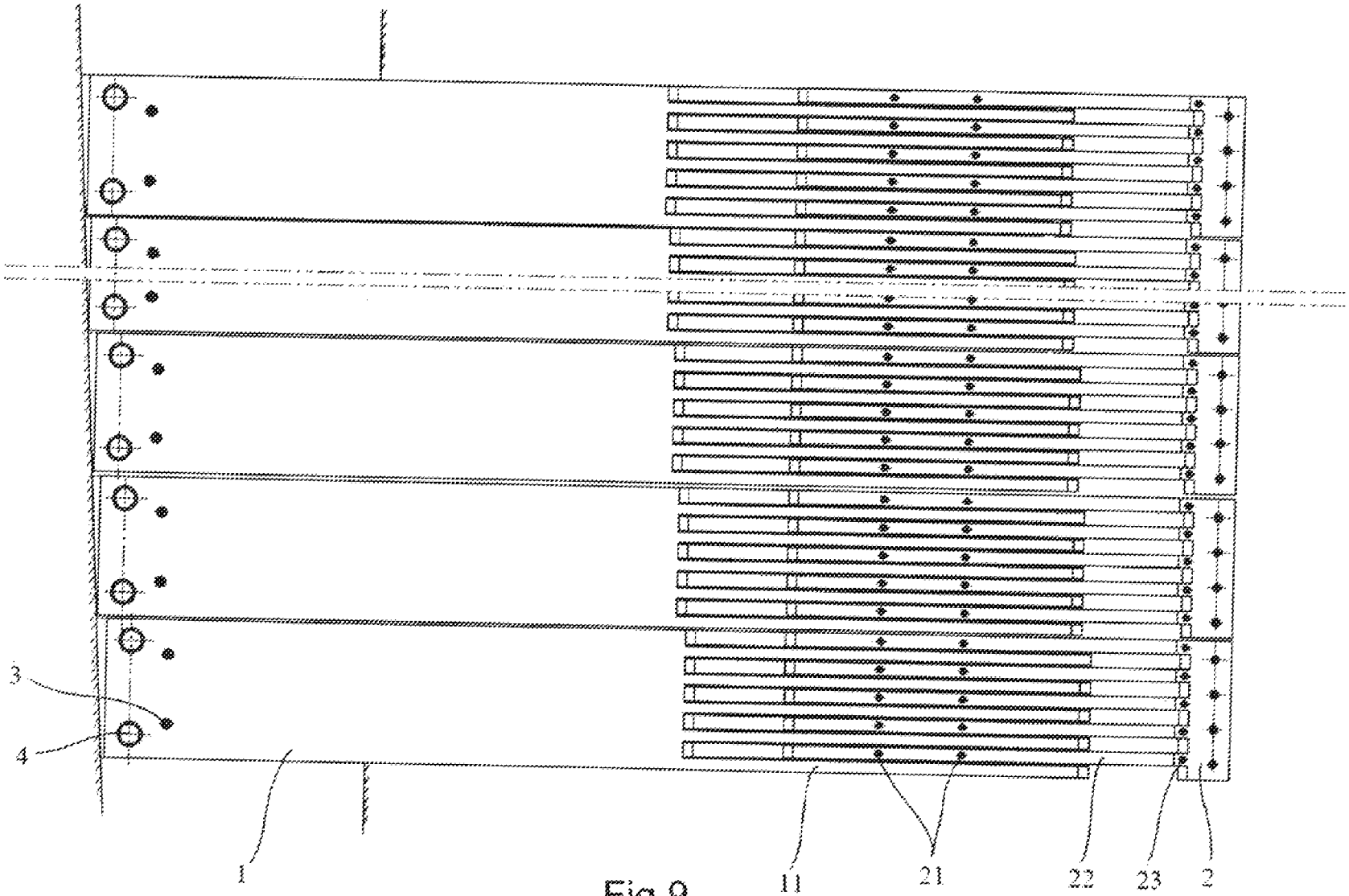
FIG. 9 is a perspective view of the expansion joint of the first embodiment of the present invention when the girder shifts transversely.
Figure 10:
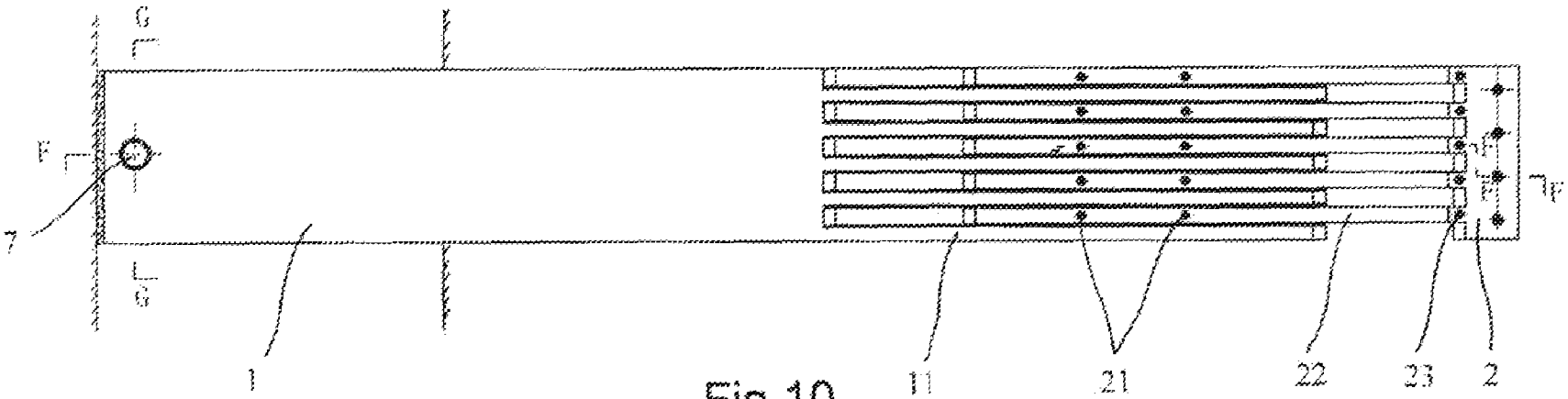
FIG. 10 is a perspective view of the expansion joint of the second embodiment of the present invention.
Figure 11:
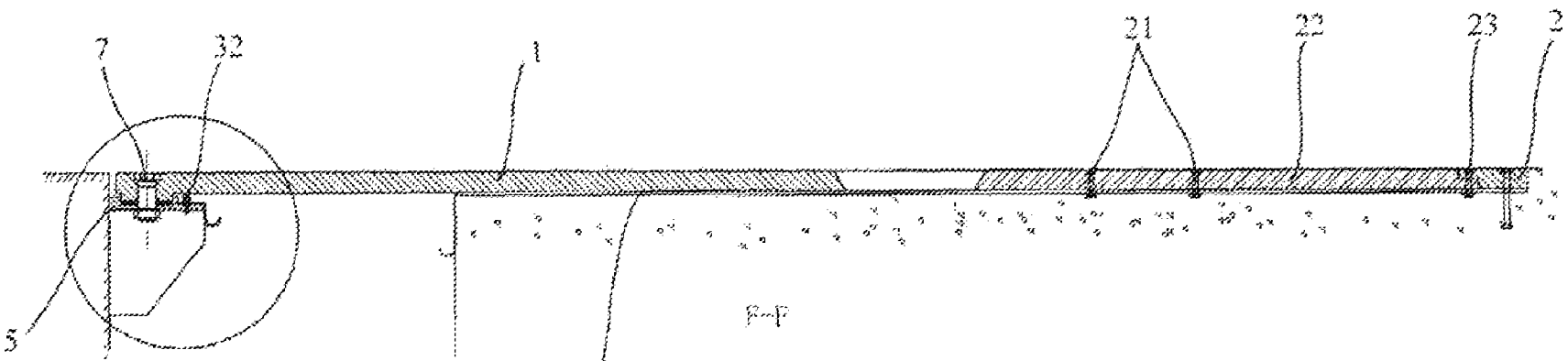
FIG. 11 is the sectional view of F-F way of FIG. 10.

When the girders shift transversely and rotate under the external forces, the movable comb plate of every module will correspondingly rotate in a certain of angle around the root of comb teeth, and make the comb teeth of the fixed comb plate shift transversely in a certain of distance, to avoid the broken of the comb teeth, as shown in FIG. 9.

FIGS. 10~14 show the second embodiment of the present invention. The difference of this embodiment compared with the first embodiment is the form of the root of said movable comb plate 1 rotatably jointing with the seat 5. In this embodiment, a columnar rotating shaft 12 projecting downwards is fixed at the bottom of the root of the movable comb plate 1, and a similar columnar pin 13 is set projecting downwards adjacent to the columnar rotating shaft 12, while the seat 5 correspondingly has a columnar groove 52 for containing said columnar rotating shaft 12 and a kidney-shaped groove 54 for containing said columnar pin 13, there respectively pad resilient supporting seats 52,55 at the bottom of said columnar groove 51 and the bottom of said kidney-shaped groove 54, and filled with resilient damp material 56 around the columnar pin 13, further more, there set a central bolt 7 which goes through the columnar rotating shaft 12 of the movable comb plate 1 and the seat 5 and makes them rotatably joint together.

Figure 12:
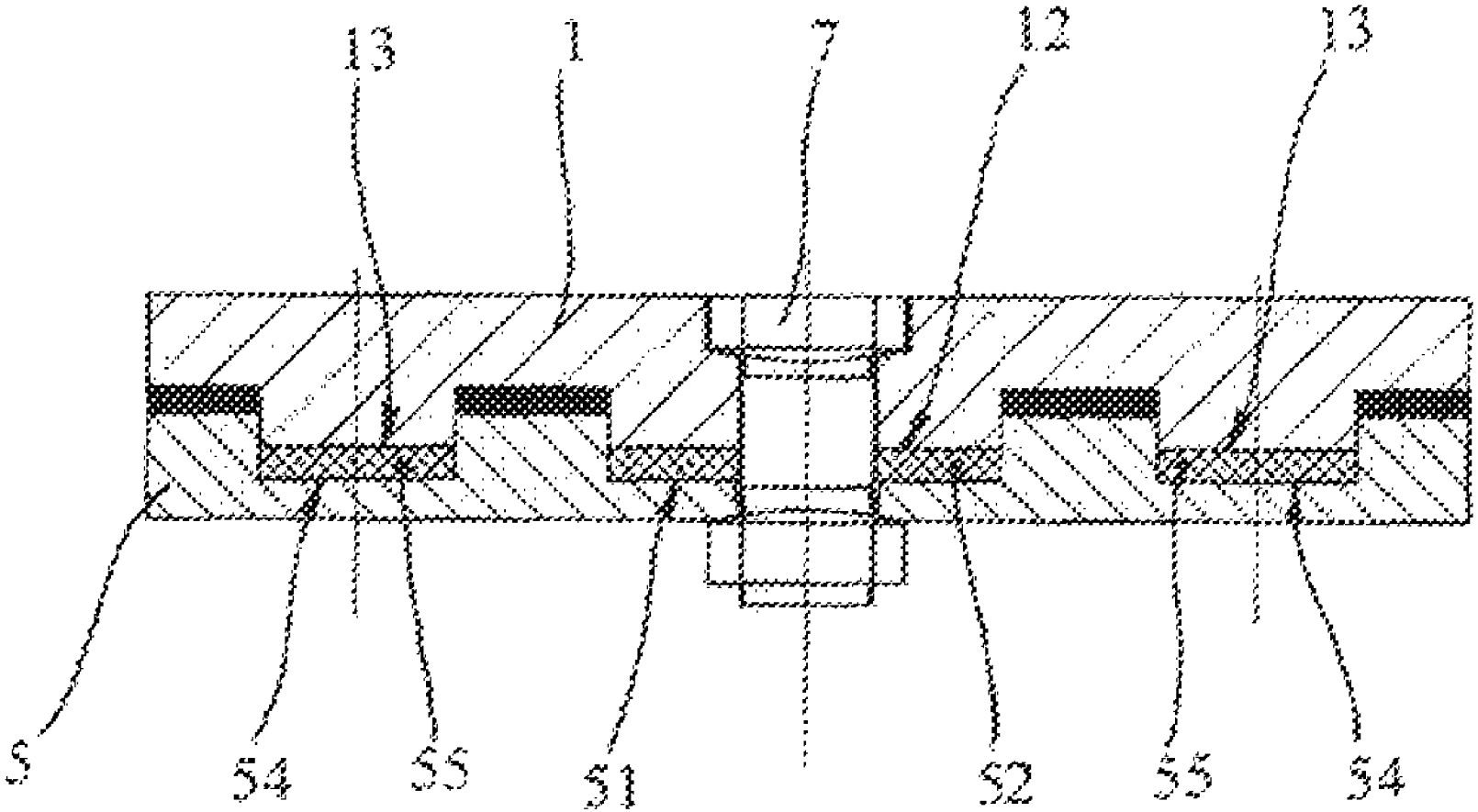
FIG. 12 is the zooming in view of the sectional view of G-G way of FIG. 10.
Figure 13:
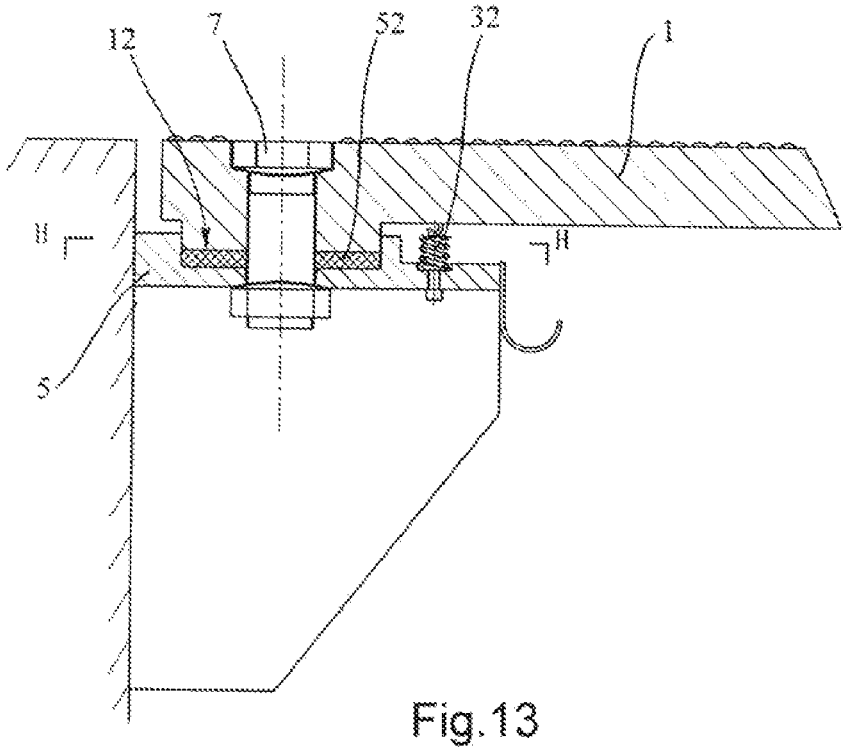
FIG. 13 is the zooming in view of part of FIG. 11.
Figure 14:
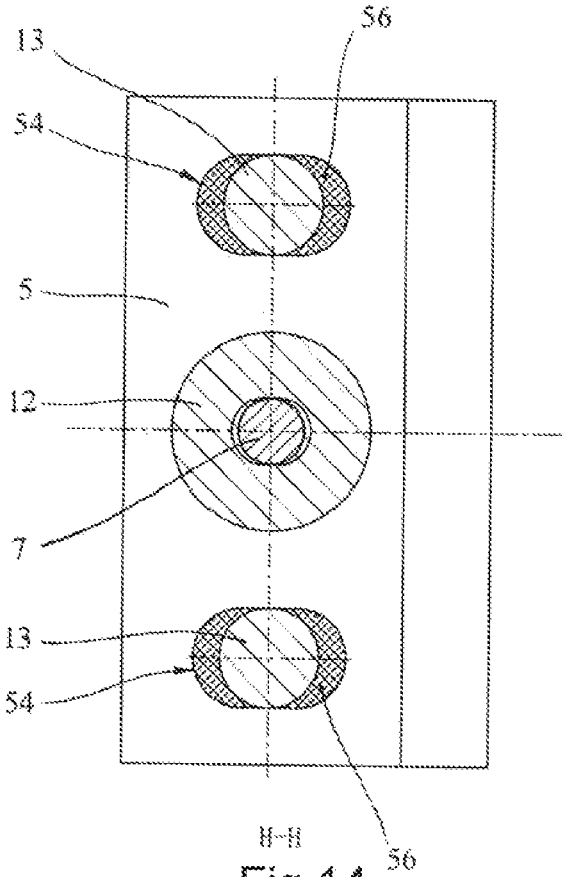
FIG. 14 is the sectional view of H-H way of FIG. 13.
Figure 15:
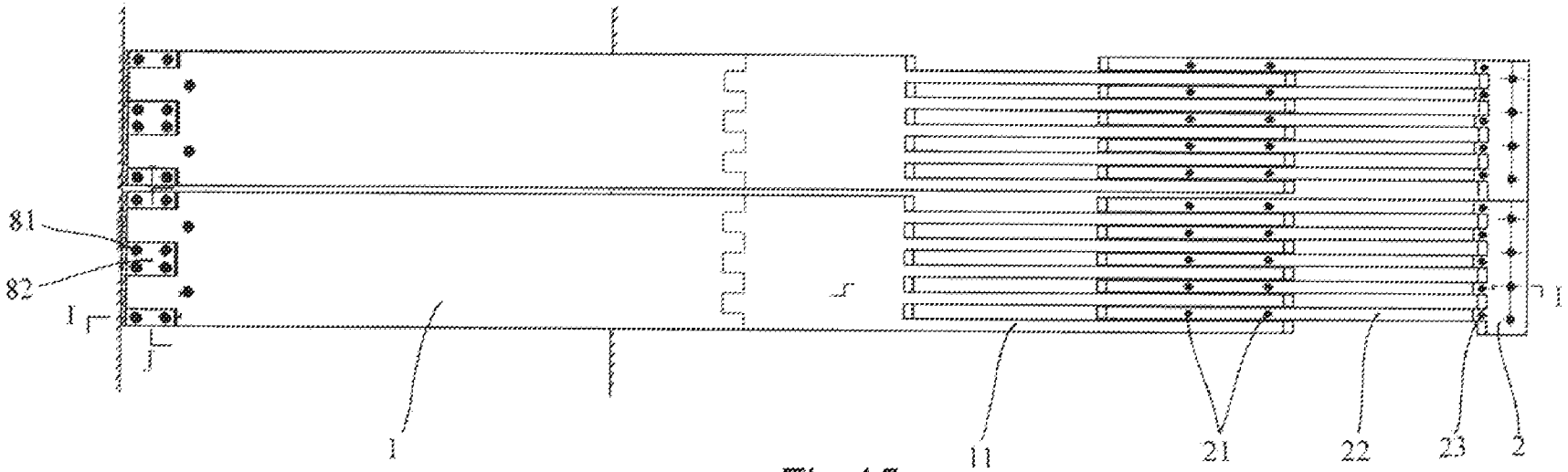
FIG. 15 is a perspective view of the expansion joint of the third embodiment of the present invention.
Figure 16:
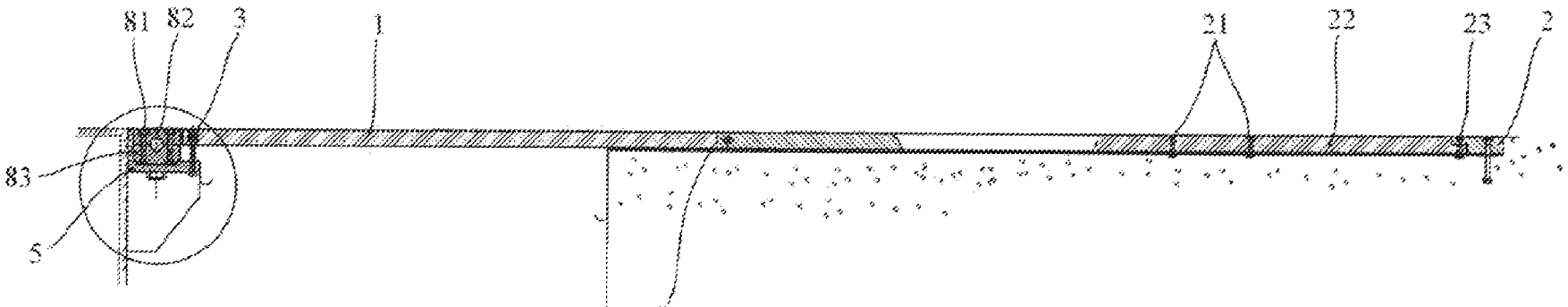
FIG. 16 is the sectional view of I-I way of FIG. 15.
Figure 18:
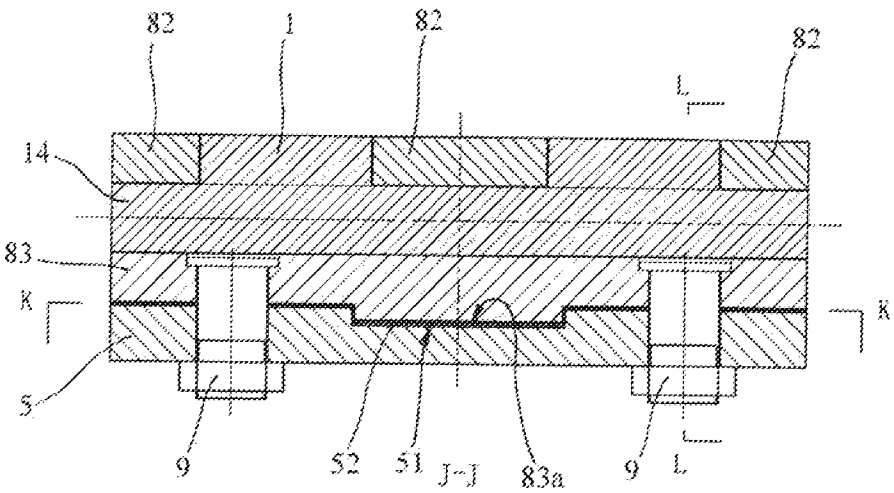
FIG. 18 is the zooming in view of the sectional view of J-J way of FIG. 15.
Figure 19:
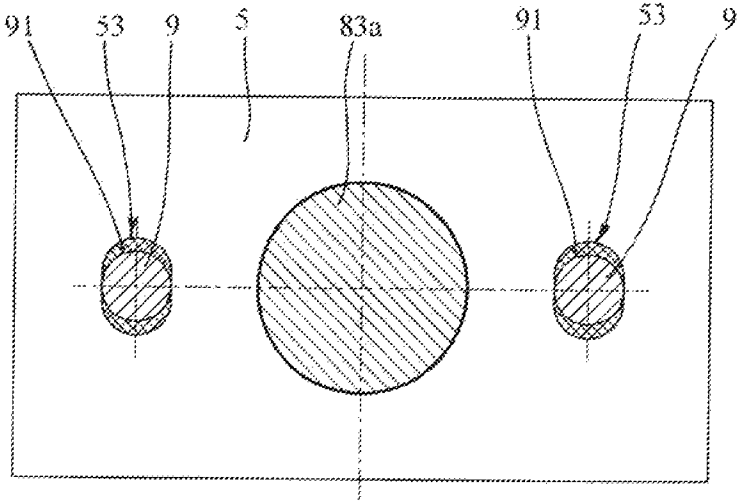
FIG. 19 is the sectional view of K-K way of FIG. 18.
Figure 17:
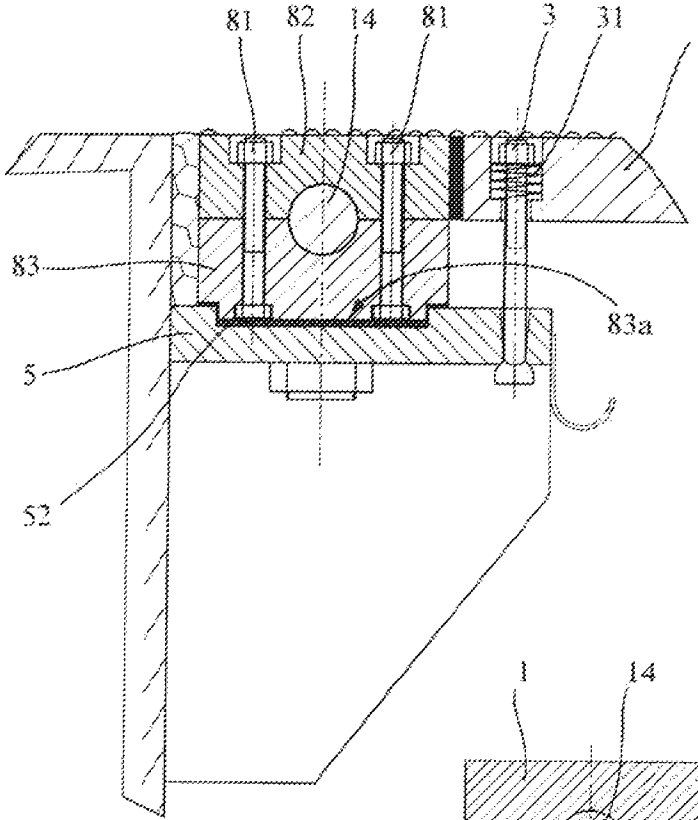
FIG. 17 is the zooming in view of part of FIG. 16.
Figure 20:
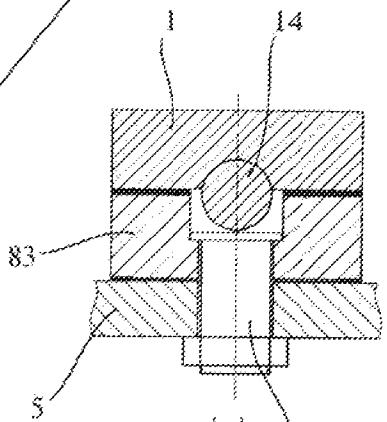
FIG. 20 is the sectional view of L-L way of FIG. 18.

To resist a certain of the vertical shift of girders, the tail step of the central bolt 7 and/or surface of the nut are/is in spherical shape, while the seat 5 and the movable comb plate 1 have a corresponding spherical-shaped groove at their corresponding place, as shown in FIG. 12 and FIG. 13.

Another difference of this embodiment compared with the first embodiment is: in this embodiment, a safe spring 32 connects the root of the movable comb plate 1 and the seat 5 instead of the safe bolt 3, as shown in FIG. 13.

FIGS. 15~20 show the third embodiment of the present invention. The difference of this embodiment compared with the first and second embodiment is the form of the root of said movable comb plate 1 rotatably jointing with the seat 5. In this embodiment, the form in fact combines the structure disclosed in the Chinese patent No. CN200410049491.5 titled "Large Resisting Distortion Comb-type Bridge Expansion Joint" invented by Bin Xu, and the ability to resist the vertical shift of the girders is further improved. The form is as bellow: The root of the movable comb plate 1 is in comb-shape, and the movable comb plate 1 has a rotating shaft 14 fixed on its undersurface, and in the comb-shaped space of the root of the movable comb plate 1, there set a shaft seat which comprises a pressing seat 82 and a supporting seat 83, while, the pressing seat 82 and the supporting seat 83 are fixed together by a bolt 81, and the pressing seat 82 has a half-columnar groove on its undersurface, and the supporting seat 83 also has a half-columnar groove on its top surface, therefore, the rotating shaft 14 is hold by said shaft seat, further more, the supporting seat 83 has a columnar rotating shaft 83*a* projecting downwards, and the seat 5 has a corresponding columnar groove 51 on the bottom of which a resilient supporting seat 52 is padded, and the supporting seat 83 and the seat 5 joint together by a fixing bolts 9 at the border part of them, in the meanwhile, the hole 53 for the fixing bolts 9 on the seat 5 is in kidney-shape, resilient damp material 91 is filled in the space around the fixing bolts 9.

The invention claimed is:

1. A large resisting distortion and modularized comb-type bridge expansion joint comprising:

at least two modules located in parallel in the direction of a bridge's width;

each said module including a fixed comb plate (2) and a movable comb plate (1), which are respectively disposed on girders located at the two sides of the bridge expansion joint, said movable comb plate (1) crosses over the bridge expansion joint;

both of said fixed comb plate (2) and said movable comb plate (1) having a plurality of comb teeth (22), (11) at their opposite ends, and the comb teeth (11) of said movable comb plate (1) interdigitate with the comb teeth (22) of said fixed comb plate (2); wherein the root of said movable comb plate (1) rotatablely jointing with a seat (5) fixed on the girder;

the comb teeth (22) of said fixed comb plate (2) rotatablely joints with the root of said fixed comb plate (2), while, the middle of the comb teeth (22) of said fixed comb plate (2) is movably set on an underlay (6) fixed on the girder, and can be shifted transversely relative to the underlay (6).

2. The large resisting distortion and modularized comb-type bridge expansion joint of claim 1, wherein the rotatablely joint between the root of said movable comb plate (1) and said seat (5) comprises:

a columnar rotating shaft (12) projecting downwards fixed at the bottom of the root of said movable comb plate (1);

said seat (5) having a corresponding columnar groove (51);

said columnar rotating shaft (12) and said columnar groove (51) jointing together by fixing bolts (4);

holes (53) for said fixing bolts (4) on said seat (5) being in kidney-shape, and filled with resilient damp material (41) around said fixing bolts (4).

3. The large resisting distortion and modularized comb-type bridge expansion joint of claim 2, wherein a resilient supporting seat (52) is padded at the bottom of said columnar groove (51).

4. The large resisting distortion and modularized comb-type bridge expansion joint of claim 2, wherein said fixing bolts (4) go through said movable comb plate (1) and said seat (5), and the tail step of said fixing bolts (4) and/or surface of the nut are/is in spherical shape, while said seat (5) and/or said movable comb plate (1) have/has a corresponding spherical-shaped groove at their corresponding place.

5. The large resisting distortion and modularized comb-type bridge expansion joint of claim 1, wherein the rotatablely joint between the root of said movable comb plate (1) and said seat (5) comprises:

a columnar rotating shaft (12) projecting downwards fixed at the bottom of the root of said movable comb plate (1);

a similar columnar pin (13) projecting downwards adjacent to said columnar rotating shaft (12);

said seat (5) correspondingly having a columnar groove (51) for containing said columnar rotating shaft (12) and a kidney-shaped groove (54) for containing said columnar pin (13), resilient damp material (56) being filled in the space around said columnar pin (13);

a central bolt (7) which goes through said columnar rotating shaft (12) of said movable comb plate (1) and said seat (5) and makes them rotatablely joint together.

6. The large resisting distortion and modularized comb-type bridge expansion joint of claim 5, wherein resilient supporting seats are padded on the bottom of said columnar groove (51) and the bottom of said kidney-shaped groove (54).

7. The large resisting distortion and modularized comb-type bridge expansion joint of claim 6, wherein the tail step of said central bolt (7) and/or surface of the nut are/is in spherical shape, while said seat (5) and/or said movable comb plate (1) have/has a corresponding spherical-shaped groove at their corresponding place.

8. The large resisting distortion and modularized comb-type bridge expansion joint of claim 1, wherein:

the root of said movable comb plate (1) being in comb-shape, and said movable comb plate (1) having a rotating shaft (14) fixed on its undersurface, in the comb-shaped space of the root of said movable comb plate (1);

a shaft seat which comprising a pressing seat (82) and a supporting seat (83) fixed together by a bolt (81);

said pressing seat (82) having a half-columnar groove on its undersurface, and said supporting seat (83) having a half-columnar groove on its top surface, therefore, said rotating shaft (14) being held by said shaft seat;

said supporting seat (83) having a columnar rotating shaft (83*a*) projecting downwards, and said seat (5) having a corresponding columnar groove (51), said supporting seat (83) and said seat (5) being jointed together by a fixing bolts (9), the hole (53) for said fixing bolts (9) on said seat (5) is in kidney-shape, resilient damp material (91) being filled in the space around said fixing bolts (9).

9. The large resisting distortion and modularized comb-type bridge expansion joint of claim 1, wherein the comb teeth (22) rotatablely joints with the root of said fixed comb plate (2) by a pilot pin (23) which goes through the comb teeth (22) and the root of said fixed comb plate (2).

10. The large resisting distortion and modularized comb-type bridge expansion joint of claim 1, wherein the comb teeth (22) of said fixed comb plate (2) joint with said underlay (6) by a pilot pin (21) which goes through the comb teeth (22) of said fixed comb plate (2) and said underlay (6), the hole (61) for the pilot pin (21) on the underlay (6) is in kidney-shape, and there fills with resilient damp material (62) at the space around said pilot pin (21), thereby the comb teeth (22) can shift transversely relative to said underlay (6).

11. The large resisting distortion and modularized comb-type bridge expansion joint of claim 1, wherein a safe spring (32) connects the root of said movable comb plate (1) and said seat (5).

12. The large resisting distortion and modularized comb-type bridge expansion joint of claim 1, wherein a safe bolt (3) connects the root of said movable comb plate (1) and said seat (5) through a compressed spring (31) which make the connection as a movable connection.

* * * * *